United States Patent [19]

Shiflet

[11] 4,033,084

[45] July 5, 1977

[54] WALLBOARDS

[75] Inventor: Frank L. Shiflet, Waynesboro, Va.

[73] Assignee: Hopeman Brothers, Inc., New York, N.Y.

[22] Filed: Oct. 31, 1975

[21] Appl. No.: 627,750

[52] U.S. Cl. ..... 52/573; 52/127; 52/459

[51] Int. Cl.[2] ..... E04B 1/68; E04B 1/94

[58] Field of Search ..... 52/573, 241, 98, 99, 52/127, 317, 393, 399, 459–469, 232

[56] References Cited

UNITED STATES PATENTS

| | | | |
|---|---|---|---|
| 2,745,779 | 5/1956 | Ritter et al. | 428/140 |
| 3,197,929 | 8/1965 | Halbostad | 52/241 |

*Primary Examiner*—J. Karl Bell
*Attorney, Agent, or Firm*—Smith, Harding, Earley & Follmer

[57] ABSTRACT

A wallboard composed of a low-strength core of gypsum or the like can be successfully faced with a decorative plastic such as melamine if plastic is used on both sides, and a sheet of steel foil is located on both sides of the core between the core and the facing material. The use of steel foil greatly reduces the likelihood that low humidity will cause the gypsum core to split as a result of shrinkage of the facing material, and the provision of plastic on both sides of the core balances the wallboard eliminating any tendency to bow.

3 Claims, 8 Drawing Figures

WALLBOARDS

BACKGROUND OF THE INVENTION

This invention relates to wallboards and particularly to a wallboard comprising a low-strength core and having a decorative plastic facing. The invention is particularly concerned with wallboards of the type suitable for use aboard ship or in the construction of hospitals, nursing homes, schools, office buildings, motels, homes and similar structures. The decorative plastic facing is particularly desirable, in these and in other applications, because of its availability in a large variety of patterns and also because of the ease with which it can be cleaned.

Currently, most decorative ship's bulkheads consist of a low-strength core composition of asbestos fiber, diatomaceous silica and organic binder, the core being provided on both sides with a laminated facing consisting of sheets of resin-impregnated paper covered by a decorative sheet and finally a transparent sheet impregnated with a synthetic resin. The resin is typically of melamine-formaldehyde. Melamine-formaldehyde is especially suited as a facing material because of its resistance to damage and also because of its transparency.

For similar, land-based installations, other plastic facing materials in use include the following in the form of thermoplastic or thermoset sheets: acrylic-polyvinyl chloride, phenylene oxide based thermoplastic sheets, polycarbonates, methacrylates, and glass fiber reinforced polyesters.

The faced asbestos wallboard is highly decorative, fire resistant, light in weight, and durable. However, it is expensive and, because of the presence of asbestos fibers, is hazardous to work with.

The synthetic resin-containing facings generally have high hygrometric coefficients so that they tend to shrink when exposed to conditions of low humidity. Shrinkage of the facing can cause the low-strength core to split so that the facings and part of the core tend to curl outwardly. In the case of faced asbestos cores, shrinkage of the facing is not considered serious because the internal bond strength of the core is usually sufficient to resist splitting except under conditions of extremely low humidity. Some difficulty has been experienced, however, where the faced asbestos core wallboard is exposed to hot, dry air.

Alternative low-strength wallboard materials are usable in various applications, but are not generally faced with melamine-formaldehyde or other shrinkable resin-containing facings because they have somewhat less internal bond strength than the aforementioned asbestos core and are subject to splitting even under commonly encountered conditions of low humidity. The most common low-strength core is gypsum, which is usually supplied with paper facing. Gypsum typically has an internal bond strength somewhat lower than that of the typical asbestos core of comparable size. The difference is such that typical faced gypsum cores exhibit a tendency to split at humidity levels below about thirty percent, while asbestos composition cores with similar facings are reasonably resistant to splitting at somewhat lower humidity levels.

While asbestos compositions and gypsum are the most commonly used low-strength core materials, various other non-metallic, non-combustible materials are usable as low-strength core materials and may be used in wallboards so long as they are provided in sufficient density, and with any necessary reinforcement, to make them suitable as structural materials. These include, for example, ceramic fiberboard, reinforced expanded perlite and hydrous calcium silicate.

The general object of this invention is to provide a faced wallboard having a low-strength core which is stable under conditions of low humidity. In accordance with the invention, a wallboard comprising a low-strength core is provided with facings on both sides, each facing comprising a synthetic resin-containing sheet having a tendency to shrink under conditions of low humidity and a sheet of metal foil, preferably steel, located between the core and the facing.

Another object of the invention is to improve the resistance of faced asbestos composition wallboard to splitting under conditions of extremely low humidity.

Another object of the invention is to enable wallboard core materials such as gypsum to be faced with melamine laminates and other synthetic resin-containing materials which tend to shrink under conditions of low humidity.

Still further objects of the invention include the provision of an inexpensive wallboard having adequate fire resistance, and structural integrity; and the provision of a wallboard particularly suited for a ship's bulkhead. The accomplishment of these objects and other objects of the invention will appear in the following detailed description when read in conjunction with the drawings.

DETAILED DESCRIPTION

The invention will be described with particular reference to a gypsum core. However, it should be understood that the same description is applicable to other low-strength core compositions.

Figure 1:
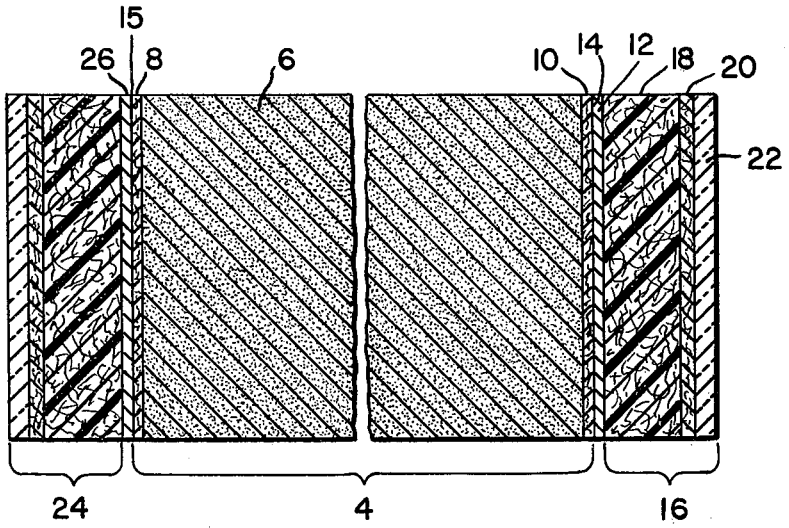
FIG. 1 is a cross-section view of a faced wallboard in accordance with the invention.

The wallboard in accordance with this invention as shown in FIG. 1, comprises a gypsum wallboard generally designated 4, having a gypsum core 6 with integral paper faces 8 and 10. A sheet 12 of steel foil is secured to the outside surface 14 of wallboard 4 by a suitable adhesive. Overlying this steel foil is a laminated sheet generally designated 16, the sheet comprising a layer 18 of kraft paper impregnated with a phenolic resin of the kind ordinarily used in decorative laminates, a decorative paper layer 20 and a transparent melamine-formaldehyde surface layer 22. The facing thus comprises a synthetic resin-containing laminated sheet 16 and a sheet of steel foil 12. A similar facing comprising laminated sheet 24 and steel foil sheet 26 is provided on the opposite side of the wallboard, against outside surface 15 of wallboard 4.

Figure 3:
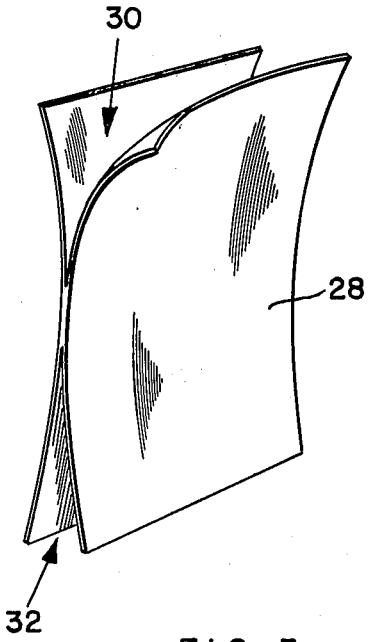
FIG. 3 is an isometric view showing the manner in which faced wallboards of the prior art tend to split when subjected to conditions of low humidity.

The synthetic resin-containing sheets 16 and 24 tend to shrink under conditions of low humidity, producing the condition illustrated in FIG. 3. FIG. 3 shows a gypsum wallboard 28 partially split at locations 30 and 32 as a result of shrinkage of a synthetic resin-containing facing, and it is this type of splitting which the invention is intended to avoid.

The steel foil may be glued to the paper face of the gypsum wallboard core with the melamine laminate thereafter glued to the steel foil. In some instances, however, it will be more economical to bond the steel foil to the unexposed side of the melamine laminate as a first step with a subsequent bonding of the steel foil to the paper face of the gypsum wallboard core.

The steel foil sheets 12 and 26 are preferably located, as shown in FIG. 1, between the core and the surfaces of the resin-containing sheets opposite the exposed surfaces. However, the steel foil sheet can be embedded in the laminated sheet at any desired location between the exposed surface of the laminated sheet and the surface opposite the exposed surface. In either case, steel foil prevents shrinkage of the laminated sheets from splitting the core material.

Typical thicknesses of the various layers of the gypsum wallboard shown in FIG. 1 are as follows: gypsum wallboard 4, 0.625 inch; steel foil layers 12 and 26, 0.0115 inch; laminated sheets 16 and 24, 0.050 inch. These dimensions are typical, and can be modified as desired to meet various different applications. For physical strengths similar to the above, using the same 0.050 inch laminated sheets 16 and 24, the steel foil layers 12 and 26 will be 0.0075 inch for a 0.750 inch gypsum wallboard 4 and steel foil layers 12 and 26 will be 0.003 inch for 1.000 inch gypsum wallboard. the 0.0115 inch steel foil is sometimes referred to as "sheet" steel. Thus, while I have used the term steel foil to identify layers 12 and 26, the term "foil" should be understood to include sheet metal. In any event, the foil should be at least approximately 0.003 inch in thickness.

Figure 2:
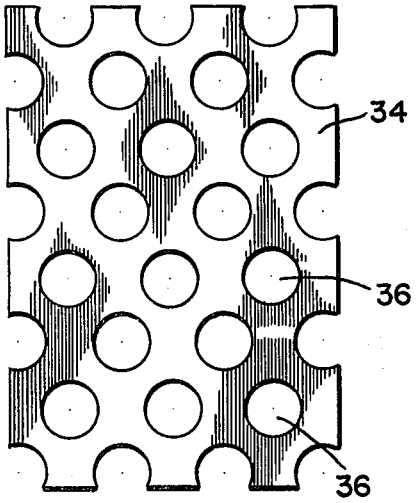
FIG. 2 is an elevation of a piece of perforated steel foil.

FIG. 2 shows a form of perforated steel foil sheet for use in layers 12 and 26 of FIG. 1. The steel foil sheet designated 34 is provided with round openings 36. The round shape was chosen because it represents the most common shape available in metal punches. However, the shape of the openings is of little consequence provided the foil is flat without bumps and possesses, in the perforated form, sufficient compressive strength in the plane of the foil to resist the shrinkage stresses of the facing. Perforated metal foil sheets provide better adhesion between the laminated sheets and the paper faces of the core because elements of adhesive extend through the perforations 36 and secure the laminated sheets directly to paper faces 8 and 10. However, unperforated steel foil can be used for steel layers 12 and 26, provided that the foil layers are positioned between the laminated sheets 16 and 24 and gypsum core 4 and a suitable adhesive is used.

As noted previously, the metal foil prevents the core from splitting as a result of shrinkage of the laminated sheets. There remains a tendency of the laminated sheets to shrink, and it is therefore necessary to provide laminated sheets as well as steel sheets on both sides of the wallboard to balance the wallboard and thereby prevent bowing. If laminated sheet 24 in FIG. 1 were not present, for example, the shrinkage of sheet 16 would cause the panel to bow so that is is concave, as viewed from the right-hand side. Therefore, unless external reinforcements are used, it is necessary to provide laminated sheets as well as metal foil sheets on both sides of the core.

Figure 4:
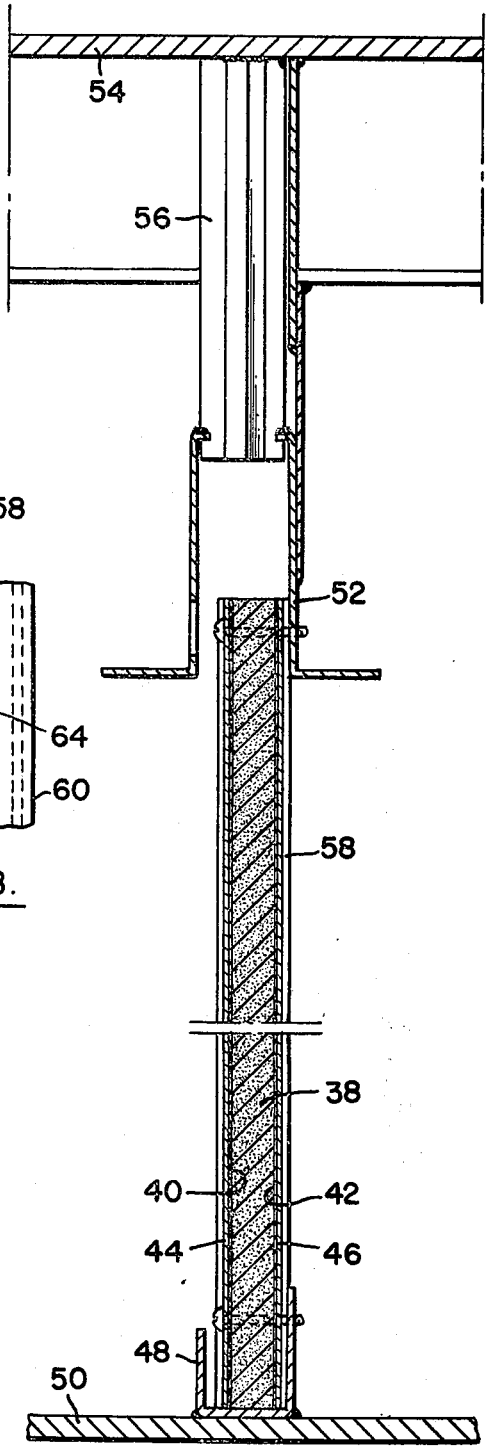
FIG. 4 is a vertical section of a typical shipboard wall panel installation using a wallboard in accordance with the invention.

FIG. 4 shows a typical shipboard installation of a wallboard in accordance with the invention. The wallboard, comprises core 38, steel sheets 40 and 42, and laminated sheets 44 and 46. It is supported at its lower edge by a channel-shaped shoe 48, welded to deck 50, and at its upper edge by a top shoe 52 suspended from deck 54 by strap 56.

Figure 5:
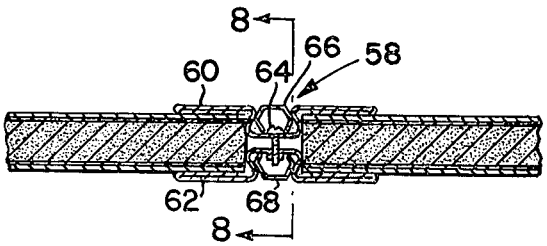
FIG. 5 is a horizontal section of a wall showing a means of interconnecting two adjoining panels.

The vertical edges of the wallboards are secured in vertical posts or end channels, one such post being shown at 58 in FIG. 4, and again in FIG. 5. Post 58 comprises a pair of separate clamping elements 60 and 62 the webs of which are secured together by a series of spaced screws or similar headed fasteners, one of which is shown at 64. The screws are hidden by snap-in trim elements 66 and 68. Elements 60 and 62 securely clamp the wallboard panels in edge-to-edge relationship, and also insure against separation of the laminated sheet from the core.

Figure 8:
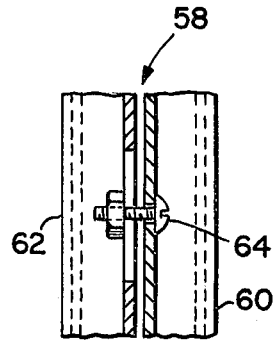
FIG. 8 is a vertical section of a wall panel interconnecting means, taken on the plane 8—8 of FIG. 5.

Element 60 is provided with round clearance holes while element 62 is provided with oblong slots, one of which is shown at 65 in FIG. 8, for receiving screws 64. These slots run in the longitudinal direction of the post. In case of fire the elongated slots in one half of post 58 makes the post limber and allows the half exposed to the fire to expand and move independently of the half on the cool side. This improves the structural integrity of the wall in case of fire because it allows the post to bend along with the wallboards.

Figure 6:
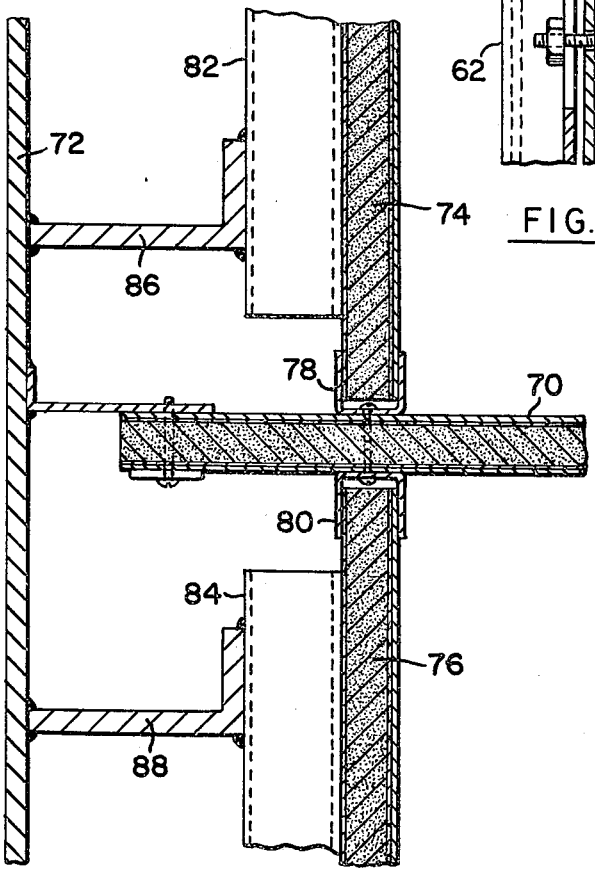
FIG. 6 is a horizontal section of a shipboard wall panel installation, adjacent to the houseside, showing a partition bulkhead comprising a wallboard in accordance with the invention.

In FIG. 6, a divisional bulkhead comprises a wallboard 70 secured in perpendicular relationship to a steel houseside 72 of the ship's structure. Lining bulkheads 74 and 76 are secured in channels 78 and 80 respectively on opposite sides of divisional bulkhead 70. While the lining bulkheads have steel sheets on both sides of the core, they have a decorative sheet only on the exposed side. Accordingly it is necessary to take precautions against bowing, and this is done by providing horizontal C-channels 82 and 84 at intermediate height and in contact with the unexposed sides of the panels. The C-channels are supported from steel bulkhead 72 by a series of vertical angles exemplified by angles 86 and 88.

Figure 7:
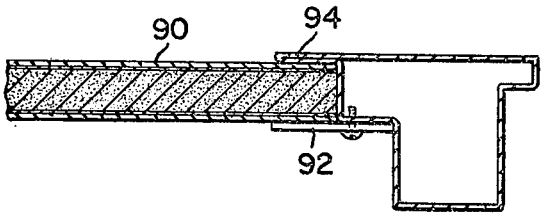
FIG. 7 is a horizontal section of a door jamb using a wall panel in accordance with the invention.

The manner in which a vertical edge of a panel is secured in a door jamb is illustrated in FIG. 7 in which panel 90 is clamped by a bar 92 against a flat vertically extending projection 94 formed as part of the door jamb.

In addition to avoiding the splitting illustrated in FIG. 3, the wallboard of the present invention, because of the presence of the metal foil, is particularly resistant to fire. The presence of metal foil allows the use of a relatively thin laminate and also a relatively thin core without reducing the physical strength of the wallboard. A thinner laminate also has less tendency to curl when secured to a gypsum core.

The most important results accomplished by the invention are the following. In the case of asbestos composition wallboards, which have been provided successfully in the past with melamine laminate facings, the provision of the metal foil sheet, as described in detail herein, greatly improves the resistance of the core to splitting where extremely low humidities are encountered. In the case of gypsum and other core compositions heretofore regarded as unsuitable for facing with melamine laminates, the invention makes practical an entirely new product.

I claim:

1. A wall system comprising at least two wallboards arranged in edge-to-edge relationship to form part of a wall, and clamping means for securing said wallboards in said relationship, said clamping means comprising first and second clamping elements;

the first clamping element having first means for engaging the face of one wallboard on one side of the wall, second means for engaging the face of the other wallboard on said one side of the wall, and web means connecting said first and second means;

the second clamping element having third means for engaging the face of said on wallboard on the opposite side of the wall, fourth means for engaging the face of the other wallboard on said opposite side of the wall, and web means for connecting said third and fourth means; and fastener means connecting said webs to each other and effecting clamping of one of said wallboards between said first and third means and the other of said wallboards between said second and fourth means;

the web of one of said clamping elements having elongated slots through which the fastener means extend, said slots permitting relative longitudinal movement of the clamping elements in the event of bending of the clamping means due to fire.

2. A wall system comprising:

a low-strength wallboard core having facings on both of its sides, each of said facings comprising a synthetic resin-containing sheet having a tendency to shrink under conditions of low humidity and a sheet of metal foil located between the core and the exposed surface of the synthetic resin-containing sheet; and means for clamping said synthetic resin-containing sheets against their adjacent metal sheets along the vertical edges of the wallboard core;

said clamping means comprising a first clamping element engaging the facing on one side of the wallboard and a second clamping element engaging the facing on the other side of said wallboard, and means securing said clamping elements against said wallboard while permitting relative longitudinal movement of the clamping elements in the event of bending of the clamping means due to fire.

3. A wall system comprising at least two wallboards arranged in edge-to-edge relationship to form part of a wall, and clamping means for securing said wallboards in said relationship, said clamping means comprising first and second clamping elements;

the first clamping element having first means for engaging the face of one wallboard on one side of the wall, second means for engaging the face of the other wallboard on said one side of the wall, and web means connecting said first and second means;

the second clamping element having third means for engaging the face of said one wallboard on the opposite side of the wall, fourth means for engaging the face of the other wallboard on said opposite side of the wall, and web means for connecting said third and fourth means; and means connecting said webs to each other and effecting clamping of one of said wallboards between said first and third means and the other of said wallboards between said second and fourth means, said connecting means permitting relative longitudinal movement of the clamping elements in the event of bending of the clamping means due to fire.

* * * * *